US007461485B2

(12) United States Patent
Toledo

(10) Patent No.: US 7,461,485 B2
(45) **Date of Patent: *Dec. 9, 2008**

(54) SECURABLE COVER APPARATUS FOR TRADE SHOW BOOTHS

(76) Inventor: Dario Toledo, 3E. 54 St., New York, NY (US) 10022

( * ) Notice: Subject to any disclaimer, the term of this patent is extended or adjusted under 35 U.S.C. 154(b) by 0 days.

This patent is subject to a terminal disclaimer.

(21) Appl. No.: 11/512,001

(22) Filed: Aug. 29, 2006

(65) Prior Publication Data

US 2007/0051052 A1 Mar. 8, 2007

Related U.S. Application Data

(63) Continuation-in-part of application No. 10/667,695, filed on Sep. 22, 2003.

(60) Provisional application No. 60/412,282, filed on Sep. 20, 2002.

(51) Int. Cl.
*E04B 1/00* (2006.01)

(52) U.S. Cl. ..... 52/222; 52/202; 52/3; 52/23; 135/114; 135/119; 160/135

(58) Field of Classification Search ..... 5/414, 5/504; 135/114, 128, 143, 151, 119, 901; 160/135, 384, 377, 264, 351; 52/202, 222, 52/23, 3; 40/604, 617
See application file for complete search history.

(56) References Cited

U.S. PATENT DOCUMENTS

| | | | | |
|---|---|---|---|---|
| 870,563 | A | 11/1907 | Kindt | |
| 1,697,027 | A * | 1/1929 | Stevenson | 5/131 |
| 2,163,359 | A | 6/1939 | Derveer | |
| 3,071,350 | A | 1/1963 | Opie | |
| 3,089,268 | A * | 5/1963 | Frey et al. | 40/604 |
| 3,237,778 | A * | 3/1966 | Hoodis | 211/119.011 |
| 3,911,537 | A | 10/1975 | Mazur | |
| 3,955,722 | A * | 5/1976 | Bard | 223/106 |
| 4,021,973 | A | 5/1977 | Hegg et al. | |
| 4,388,786 | A | 6/1983 | Gassler | |
| 4,493,172 | A | 1/1985 | Jones | |
| 4,632,138 | A | 12/1986 | Irwin | |
| 4,640,332 | A | 2/1987 | Turner | |
| 4,725,030 | A * | 2/1988 | Miller et al. | 248/297.21 |

(Continued)

FOREIGN PATENT DOCUMENTS

| | | |
|---|---|---|
| CN | 2215547 | 12/1995 |

*Primary Examiner*—Richard E. Chilcot, Jr.
*Assistant Examiner*—Chi Q Nguyen
(74) *Attorney, Agent, or Firm*—Gottlieb, Rackman & Reisman, P.C.

(57) ABSTRACT

This invention relates to a security apparatus for trade show booths comprising a flexible cover section to enclose an opening in a booth structure and a means for securely fastening the edges of the cover section to an opening of a booth structure so as to provide a securable removable cover to deter individuals from stealing merchandise from a display booth or otherwise enclose the booth for privacy. In one embodiment, adjustable fasteners that are used to secure the vertical edges of the cover are provided in a manner that does not permit removal from outside of the cover when installed. These fasteners may comprise a hooked end, an arc-shaped engagement end and a tightening member between said hooked end and engagement end which work together to secure the vertical edges of the cover.

22 Claims, 16 Drawing Sheets

U.S. PATENT DOCUMENTS 4,779,294 A 10/1988 Miller
4,805,735 A 2/1989 Anderson
4,986,389 A 1/1991 Halligan et al.
5,010,909 A 4/1991 Cleveland
5,174,086 A 12/1992 Payne et al.
5,197,239 A * 3/1993 Glynn et al. ..... 52/63
5,246,052 A 9/1993 Homan
5,377,711 A 1/1995 Mueller
5,520,292 A 5/1996 Lombardi
5,522,165 A * 6/1996 Molla ..... 40/604
5,560,384 A 10/1996 Oh
5,680,893 A 10/1997 Neer
5,768,722 A * 6/1998 Olson et al. ..... 5/9.1
5,813,641 A 9/1998 Baldwin
5,816,000 A 10/1998 Izatt et al.
5,819,474 A 10/1998 Strom
5,839,237 A 11/1998 Davidson
5,897,088 A 4/1999 Kirschner
5,906,004 A 5/1999 Lebby et al.
5,916,091 A 6/1999 Schultz
5,941,399 A 8/1999 Wang
5,966,877 A 10/1999 Hawes
6,067,911 A 5/2000 Marker et al.
6,105,912 A 8/2000 Lindsay et al.
6,119,317 A 9/2000 Pfister
6,145,528 A 11/2000 Egnew et al.
6,164,005 A 12/2000 Copeland
6,176,050 B1 * 1/2001 Gower ..... 52/222
6,325,085 B1 * 12/2001 Gower ..... 135/90
6,353,946 B1 * 3/2002 Steiner ..... 5/121

* cited by examiner

FIG. 2
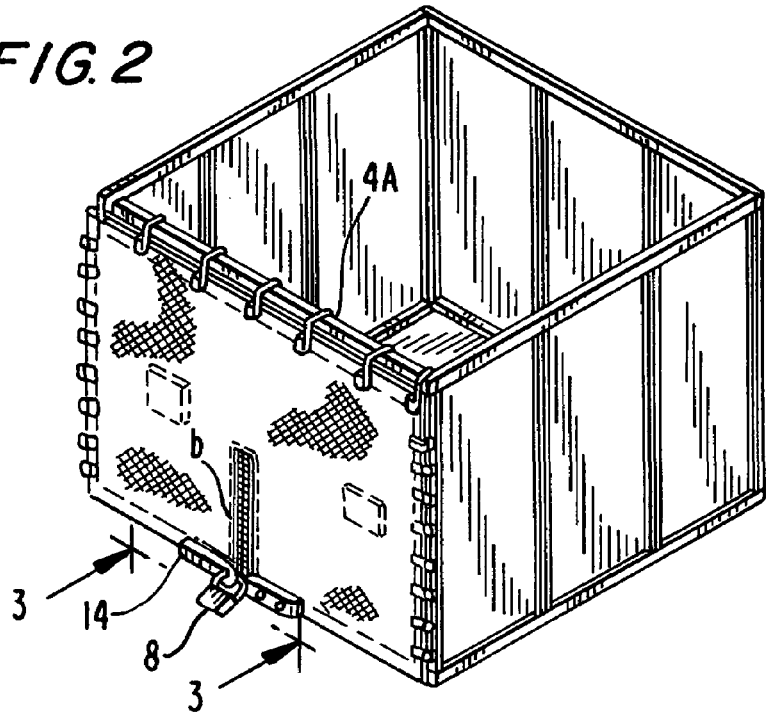
FIG. 3
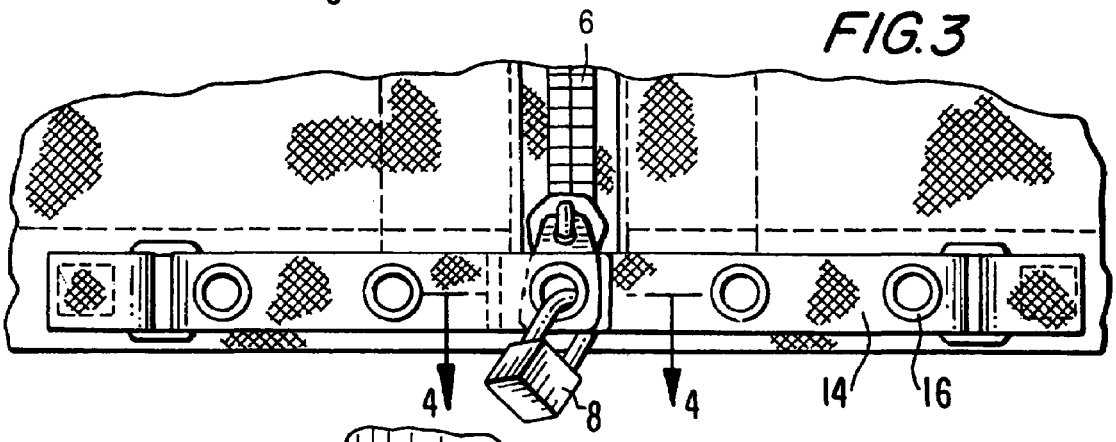
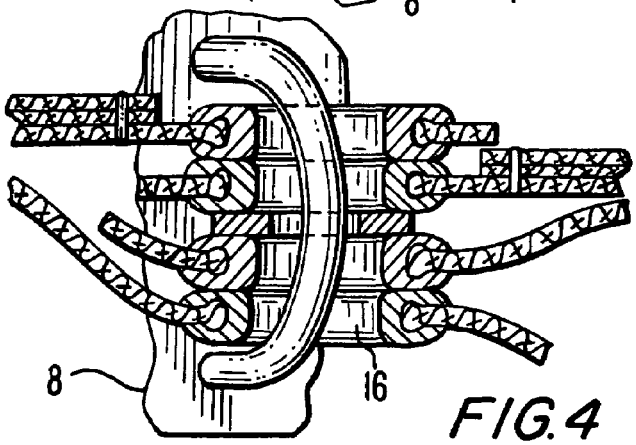
FIG. 4

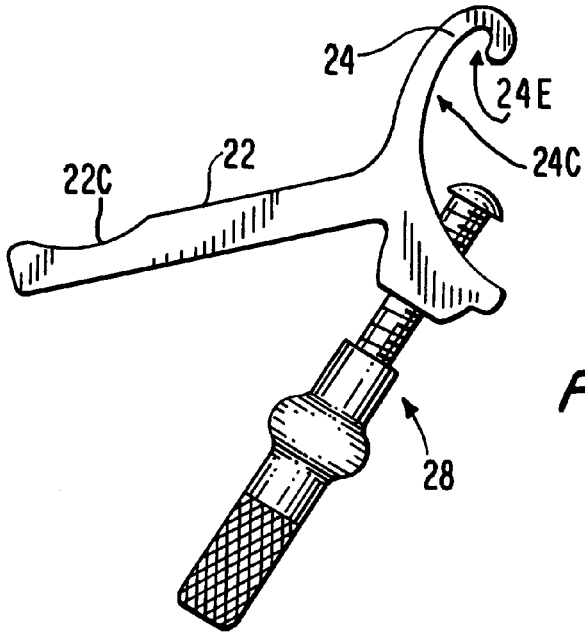
FIG. 16
FIG. 17
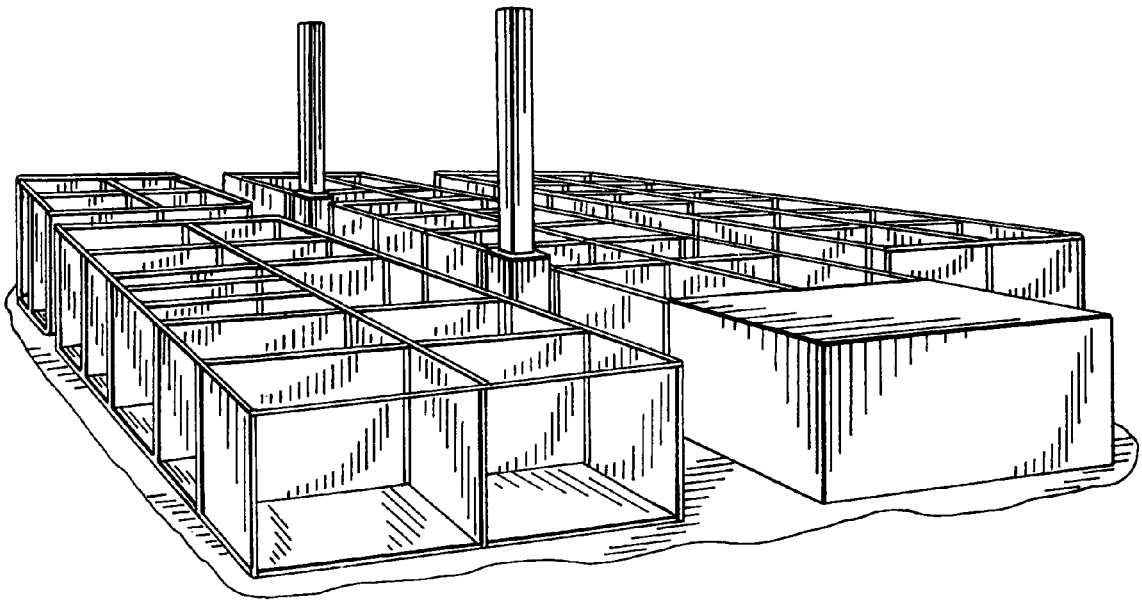

SECURABLE COVER APPARATUS FOR TRADE SHOW BOOTHS

INTRODUCTION

This application is a continuation-in-part application of application Ser. No. 10/667,695, filed on Sep. 22, 2003, which claims the priority of the U.S. provisional application, Application Ser. No. 60/412,282, filed on Sep. 20, 2002, both of which are incorporated herein by reference.

FIELD OF INVENTION

This invention relates to systems for providing secure enclosures for temporary structures. More specifically, the invention involves an apparatus for providing a securable enclosure for temporary booths typically used at trade shows.

BACKGROUND OF INVENTION

The industry of organizing and operating trade show events is complicated by common concerns that patrons have for protecting their wares from being stolen. Typically, trade show booths have walls or partitions on all but one of its sides. One side is left open to maximize the presentation area for potential viewers during the trade show. While this opening is particularly useful during trade show hours, it can present a problem during the off hours.

During the off hours of a show, it is convenient for booth operators to keep their products and wares in the booths to avoid the repetition of having to set up for each day of the show. However, this poses certain risk. Due to the open nature of the booth, there is little protection for the products and wares from being stolen.

One potential solution to the problem is to restrict entry to the trade show venue. However, taking this action does not prevent those who need to enter from stealing merchandise from a patron's booth. Moreover, hiring security guards to protect each booth is not economical.

The prior art does not teach an acceptable apparatus for providing a secure enclosure in the context of trade show booths. For example, partition systems taught by Hegg et al. (U.S. Pat. No. 4,021,973), Gassler (U.S. Pat. No. 4,388,786), Jones (U.S. Pat. No. 4,493,172), and Izatt et al. (U.S. Pat. 5,816,000) could not adequately serve this purpose. While they generally teach partition systems that may be used to construct discrete spaces for use as office dividers or convention exhibition booths, these systems are not designed to provide removable openings that satisfy the needs of trade show booth operators. In short, they lack a design for coverage of spacious openings while simultaneously promoting easy installation, removal and compact storage.

BRIEF DESCRIPTION OF THE INVENTION

The principal objective of the present invention is to provide a booth enclosure apparatus to provide a level of protection for exhibitors' merchandise from theft when the exhibitor is not present and the booth is not being used.

A further objective of the present invention is to provide such an apparatus that is simple to install and simple to remove.

An additional objective is to provide such an apparatus that is compact to store when not in use.

Another objective is to provide a simple removable means for show exhibitors to obtain a level of privacy while setting up an exhibit in a booth or otherwise prevent others from observing the exhibit at certain times.

A still further objective is to provide such an apparatus that will be compatible with the booth structures commonly used at trade shows.

Additional objectives will be apparent to those skilled in the art from the description of the invention as contained herein.

In its broadest aspects, the invention is a booth enclosure apparatus. The apparatus utilizes a flexible cover section to enclose an opening in a booth structure and a means for securely fastening the edges of the cover section to an opening of a booth structure so as to provide a lockable, removable cover to deter individuals from stealing merchandise from a display booth or otherwise enclose the booth for privacy. Optionally, a lockable opening in the cover provides restricted access to the inside of the booth useful for removal and installation of the enclosure apparatus. In one embodiment, adjustable fasteners are provided with a structure to secure the vertical edges of the cover to side support posts of the booth structure in a manner that does not permit removal from outside of the cover when installed. Optional hooks or hangers are used to hang the top edge of the cover to a top horizontal cross bar support. The cover may be provided with an adjustment belt to ensure that the cover remains taut on the support structure when locked in its fastened position.

BRIEF DESCRIPTION OF THE DRAWINGS

FIG. 2 illustrates the booth of FIG. 1 with an embodiment of the invention attached thereto;

FIG. 3 depicts a partial view of one embodiment of a lockable zippered portion from an opening in an enclosure apparatus of the invention along lines 3-3 of FIG. 2;

FIG. 4 depicts a cross sectional view of the lock portion taken along lines 4-4 of FIG. 3;

FIG. 16 depicts a further embodiment of a fastener of the invention;

FIG. 17 depicts several booths in a trade show;

DETAILED DESCRIPTION OF THE INVENTION

The invention is an apparatus for providing a level of protection for trade show booths in the form of a removable closure apparatus. The apparatus includes a flexible cover 2 to enclose an opening in a booth structure and a means for securely fastening the cover 2 to a support structure of the booth. With the invention a lockable, removable cover can deter individuals from stealing merchandise from a display booth and can be compactly stored.

Figure 1:
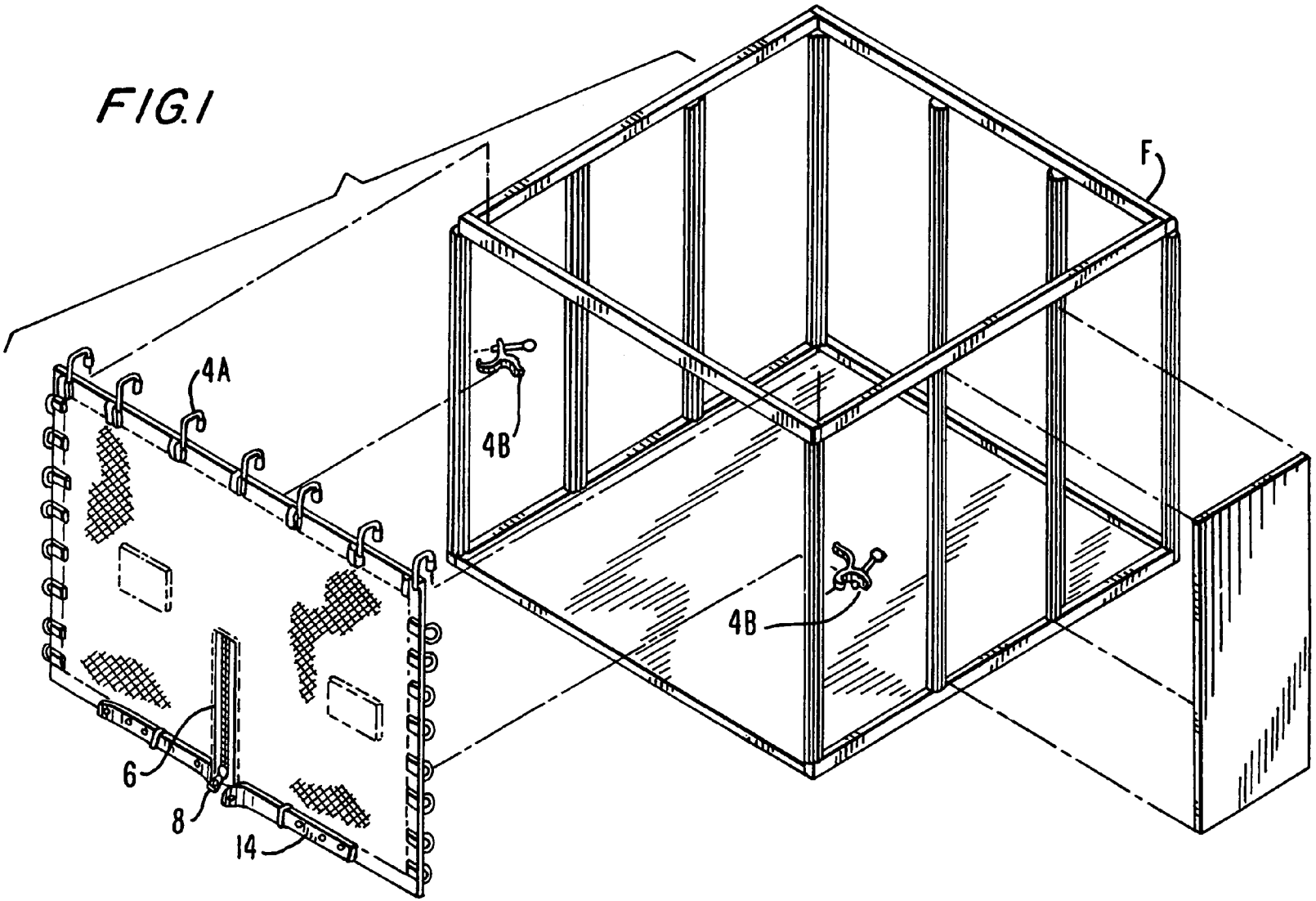
FIG. 1 depicts a typical booth support structure and an embodiment of the invention separated from the booth.

Referring to the drawings, FIG. 1 depicts a typical support structure or frame F of a trade show booth that may be used at trade shows. Normally, three of the four sides of the booth are fixed firmly by attaching temporary hard walls or partitions along support poles that have channels running the length of the pole. One or more presentation sides may be left open to maximize the display area during the tradeshow hours. For protection after show hours, the apparatus includes a cover 2 and means for securely fastening the cover 2 to the frame F. Optionally, a lockable opening 6 in the cover 2 is provided. In FIG. 1, the cover 2 is shown in an unfastened position. FIG. 2 depicts the cover 2 in a fastened position on the frame F.

The cover 2 is sized to cover a presentation area of the frame F of a booth but flexible to be compactly stored when removed. The cover 2 is rectangular in shape to accommodate typical booths. If too large a cover is used, no level of protection can be achieved since a loose cover can be easily circumvented. Thus, a rectangular section of material of appropriate size is of a width in a range of about 110 to 120 inches, preferably about 116, and a height in a range of about 85 to 105 inches, preferably about 94. The cover 2 includes a section of material or tarpaulin and may be formed of canvas, fabric, heavy plastic, synthetic polyester, Kevlar or other appropriate material. The preferred material is durable, not easy to tear or otherwise breach so that a level of security can be obtained. The material may also be provided as a fire retardant fabric to satisfy any applicable fire codes pertinent to the location of use and/or to help prevent the contents of a booth from catching fire from an external source. With stronger materials greater protection can be achieved to protect the contents of the booth, for example, by making the cover from Kevlar, which would be resistant to cutting by sharp objects such as a knife. The material may be transparent but opaque material is favored so that the contents of a booth will not attract undesired attention. Preferably, the cover also does not have an incorporated frame such that it has no independent rigid structure. This promotes ease of assembly and storage so that it may fold compactly when removed from the frame of the booth.

A lockable access opening 6 in the cover 2 provides restricted access to the inside of the booth for removal and installation of the enclosure apparatus. Provision of such an opening is particularly appropriate where the means for securing the cover 2 to the frame F are only removable from the inside of a booth when the cover 2 is in the fastened position. Such fasteners are described in more detail herein. The access opening 6 may also serve to simplify authorized entry into a booth without the need for removing the cover 2 from the frame F. As shown in the embodiments of FIGS. 1, 2 and 3, there is provided a lockable zippered access opening 6 within the cover 2. Typically, after the cover 2 is in the fastened position, a user may unzip the access opening 6, exit, close the zipper and then attach a lock 8 to the bottom of the zipper. While the disclosed embodiments show a zippered access opening 6, it should be understood that other lockable openings can be utilized to practice the invention.

As previously mentioned, the cover 2 requires a means for securing it to the frame. The means for securely fastening should promote secure but easy removal such that it inhibits unauthorized users from removing the cover, but is also easy for the booth occupant to apply and remove. To this end, different types of hooks, hangers, fasteners or attachment members 4, 20, 120, 220 may be used with the invention. In addition, in one embodiment, the means for securing is permanently fixed to the cover 2 for ease of use or they may optionally be removable from the cover when they are not securing the cover 2 to the support frame F.

Figure 5:
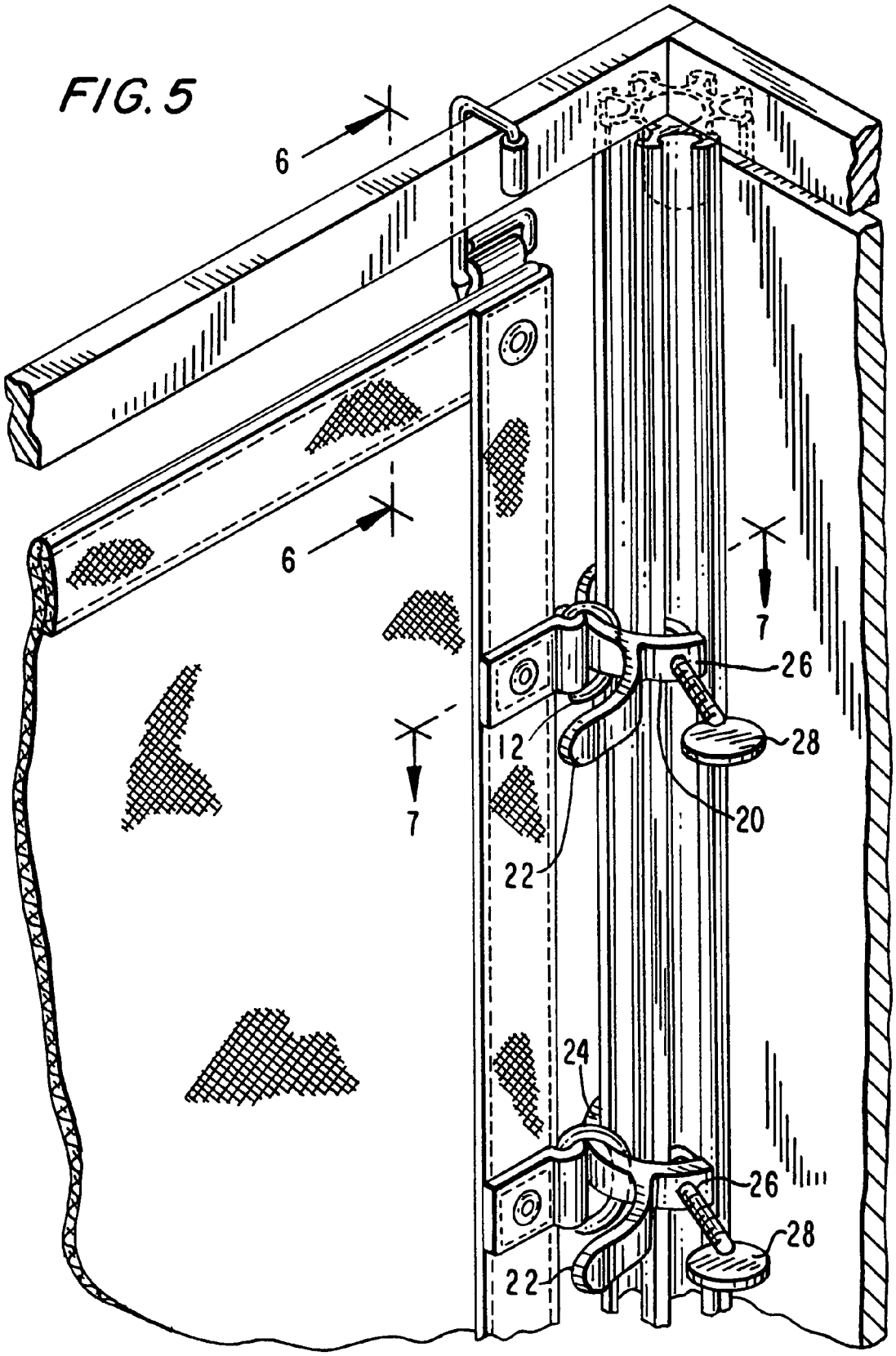
FIG. 5 depicts an interior view of a portion of a cover of the invention attached to booth support structure.
Figures 6, 7:
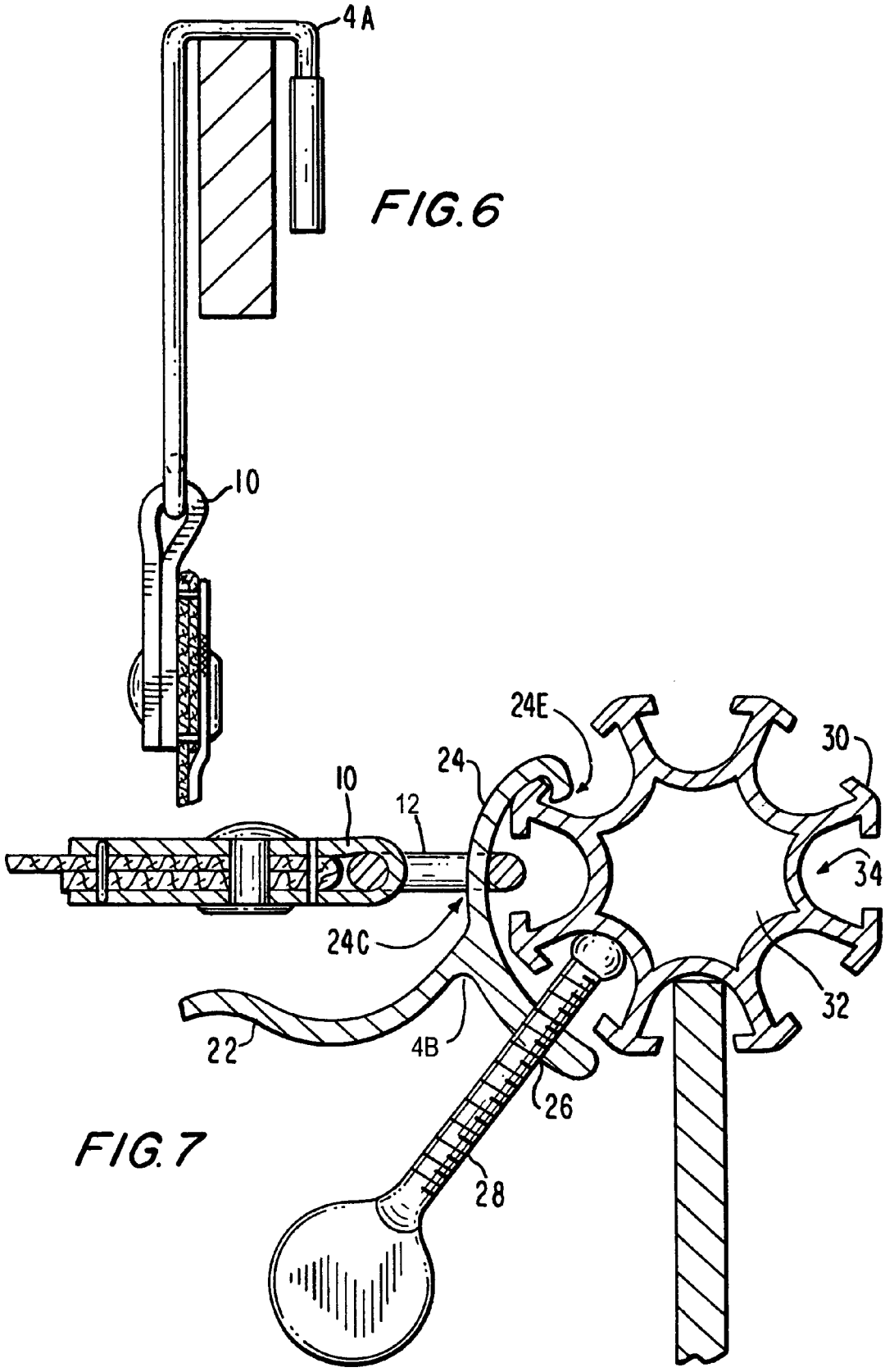
FIG. 6 depicts one embodiment of a fastener engaging a horizontal top booth support structure.
FIG. 7 is a plan view cross-section of another fastener engaging a vertical booth support structure.
Figure 8:
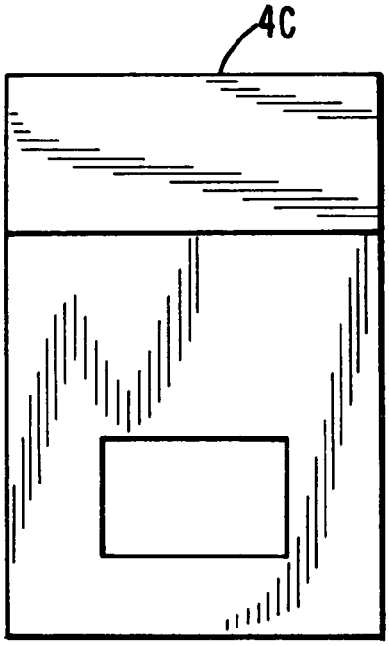
FIGS. 8-10 show an alternative embodiment of a fastener of the invention.
Figure 9:
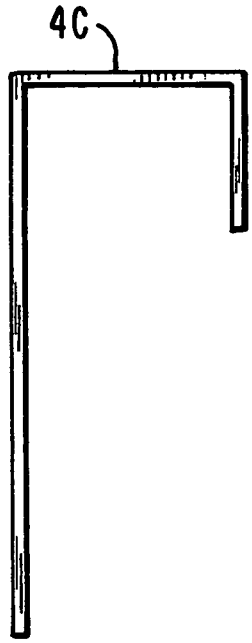
Figure 10:
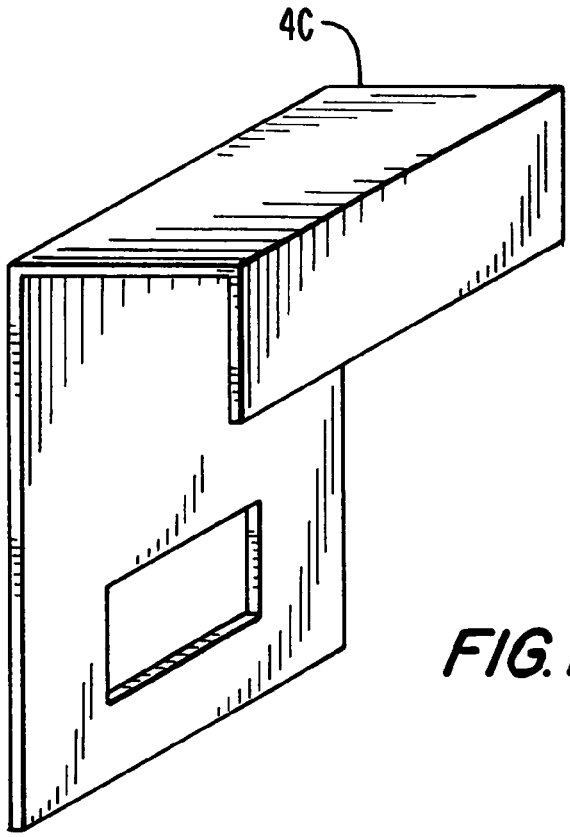

In one embodiment, as shown in FIGS. 5, 6 and 7, along the edges of the cover 2, straps create loops 10. The loops 10 may be attached to the cover a distance in from the perimeter edge of the cover 2 so that the outer edge of the loop 10 coincides or is no further than the perimeter edge of the cover 2. By such a design, when installed on a frame, the space between the frame and perimeter edge of the cover 2 is minimized to impede physical or visual access to the booth.

Figure 11:
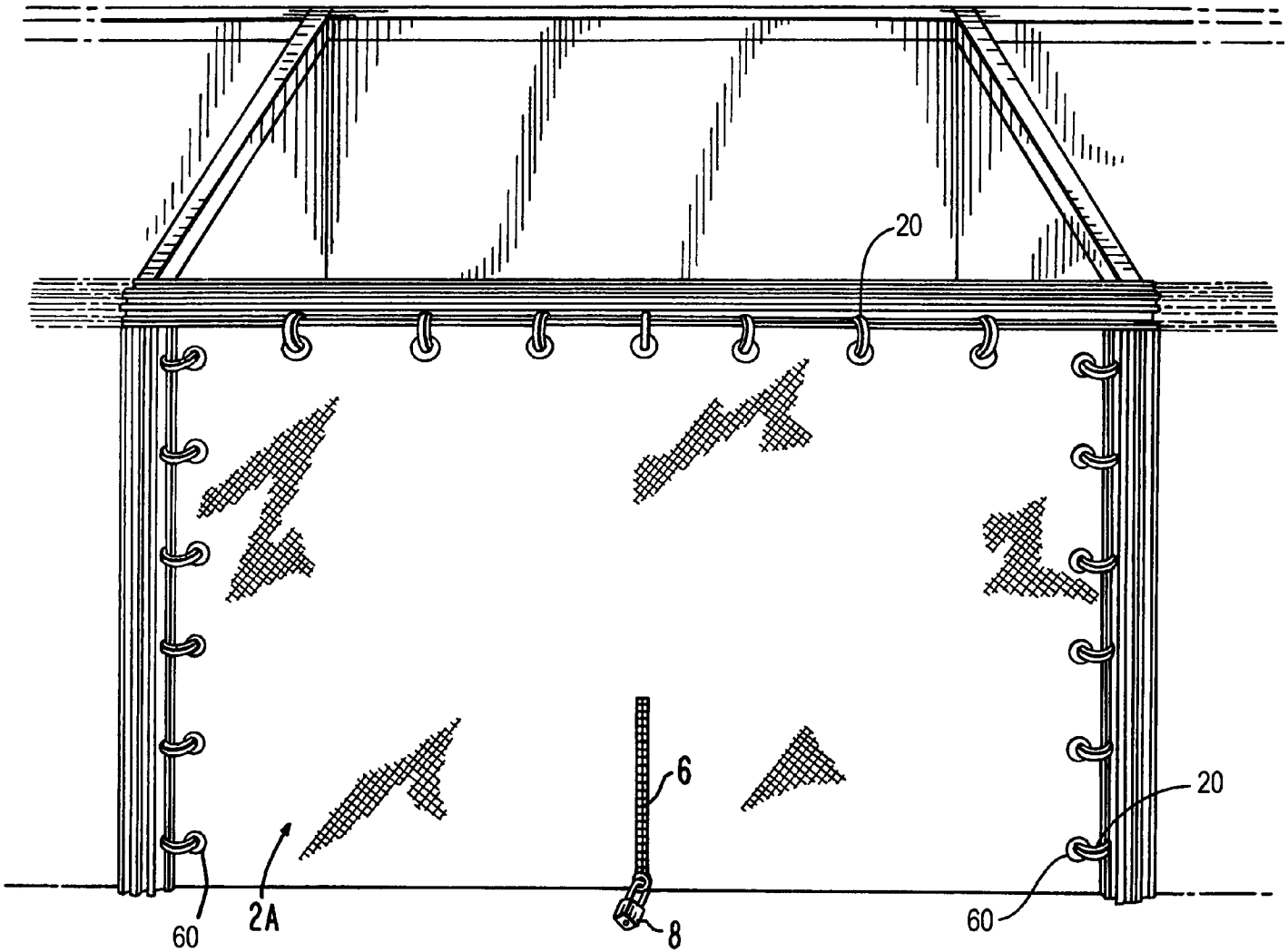
FIG. 11 depicts a booth with an alternative embodiment of the cover apparatus of the invention.
Figure 12:
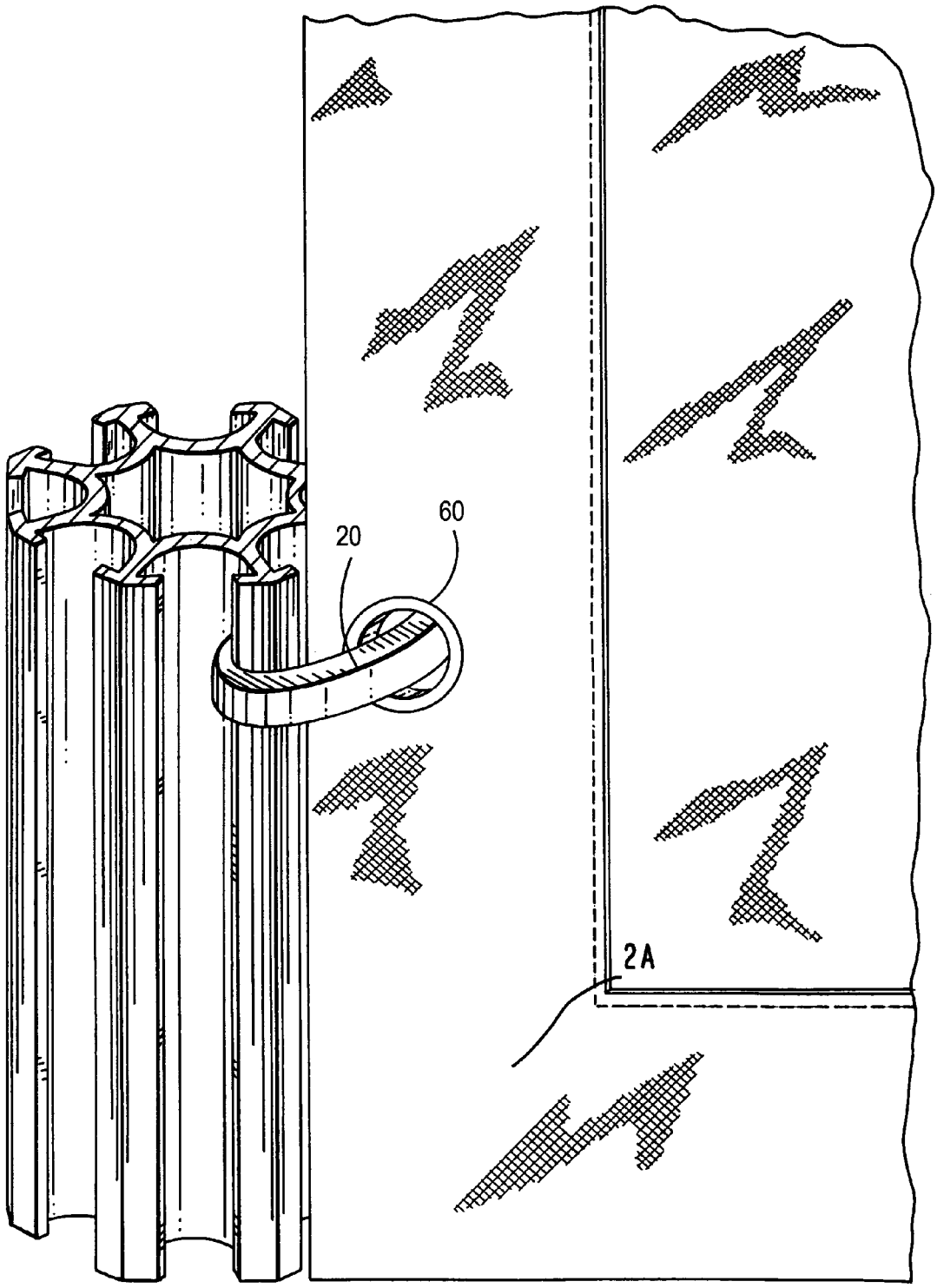
FIG. 12 depicts another embodiment of a fastener of the invention.

The loops 10 are also designed for coupling to attachment members for connecting the cover 2 to the support frame F of the booth. These loops 10 can be permanently attached (i.e., grommet, stamped, sewn etc.) or temporarily attached (i.e. snaps on one end of the loop) at different edges of the cover depending on the need for a secure coupling. For example, the vertical edges should be secured so the loop 10 is permanent or not easily removable. For convenience, the loops 10 along the horizontal top edge may be temporarily attached with snaps. Leather or other durable material may be used to form each strap. As an alternative to providing such loops 10, grommets 60, as shown in FIGS. 11 and 12, may be applied to the edges of the cover 2A to serve a purpose of the loops 10.

In this embodiment, along the top horizontal edge that connects with a top horizontal cross bar of the booth frame F, the cover 2 is attached by hooks 4A or hangers 4C, 4D, 4E. One example of a hook is shown in FIG. 6 and examples of hangers are shown in FIGS. 8-10 and FIGS. 23 and 24. Alternatively, the hooks 4A or hangers 4C, 4D, 4E can easily be constructed to be permanently or temporarily attached to the cover 2 with or without the use of straps. The hooks 4A or hangers 4C, 4D, 4E are not tightened to the frame F but merely hang thereon. This promotes ease in attaching and removing the cover 2. The hooks 4A or hangers 4C, 4D, 4E also permit the cover 2 to be moved by sliding along the cross bar. Hooks 4A or hangers 4C, 4D, 4E used in this fashion may be used along the top edge without any increased security risk if more permanent fasteners secure the sides of the cover 2.

Figure 23:
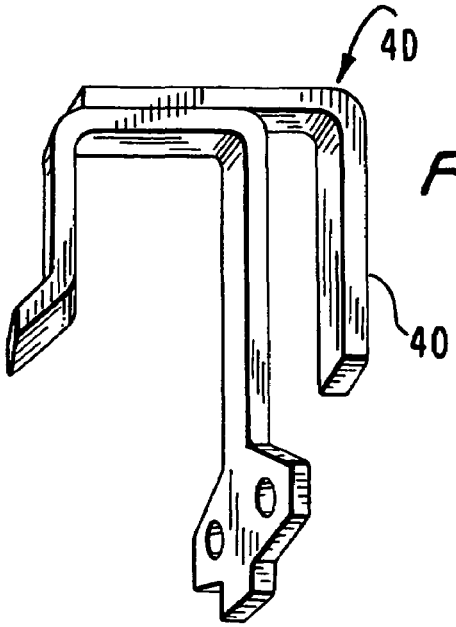
FIG. 23 depicts another embodiment of a fastener of the invention with an installation extension.
Figure 24:
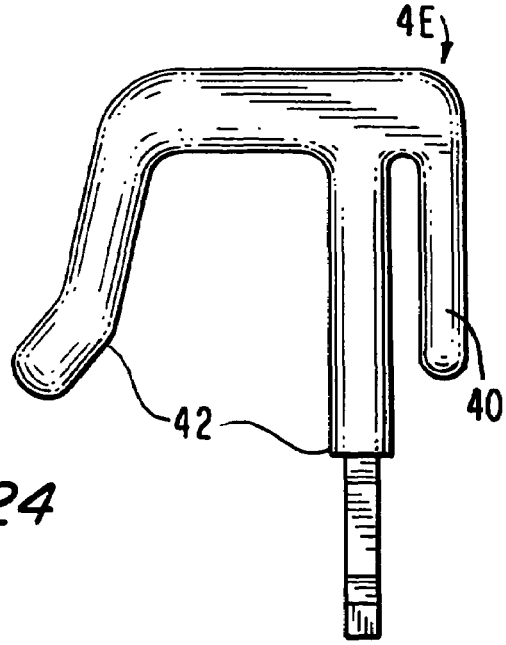
FIG. 24 depicts the embodiment of the fastener of FIG. 23 with a protective casing.

Since the cross bar upon which the hooks 4A or hangers 4C, 4D, 4E are suspended is generally elevated beyond a typical user's reach, there is provided on hangers 4D, 4E an installation extension 40 opposite the hanging portion, as shown in FIGS. 23 and 24, whereby a user may simply use an application pole or lifting device to easily lift hangers 4D, 4E onto or off of the cross bar without the use of an elevated surface such as a chair. The application pole is constructed with an engaging end that corresponds to the shape of the installation extension 40. Accordingly, the engaging end of the application pole forms a cylindrical structure, U-shaped end or other shaped structure that engages the installation extension 40 and lift hangers 4D, 4E onto or off of the cross bar. Use of the application pole and installation extension helps prevent injuries to all persons who would otherwise use an unsteady elevated surface or ladder. It also aids all users, especially those with physical impairments, from overly exerting themselves in the course of using the apparatus. The installation extension 40 and hanger 4D, 4E can be constructed or molded as a unitary structure as well as separate structures which are then fused or attached together. In this embodiment, hanger 4E may also be provided with a protective casing 42 such as a rubber cover to prevent damage or scratching to the hanger or the cross bar. Obviously, other appropriate forms of hangers and hooks can be used as well in conjunction with this invention.

In one embodiment of the invention, for fastening the vertical edges of the cover, a securable fastener 4B is used, as shown in more detail in FIG. 7. Other embodiments of securable fasteners 4B, 20, 120, 220 which are preferably used to fasten the vertical edges of the cover are shown in FIGS. 11-14, 16, 18-22 and 25-28. To couple with the fastener 4B, rings 12 are installed in the loops 10. The devices are made from a rigid and durable material such as a metal or alloy. Generally, the securable fastener 4B includes a handle portion 22. The securable fastener 4B also includes a hooked portion 24 for grasping an edge of the support frame F and holding a ring 10. In addition, the securable fastener 4B has a tightening member 28 at another end of the fastener 26 that when combined with the hooked portion 24 holds the fastener 4B to the frame F. Optionally, the securable fastener 4B, 120, 220 itself may be fixed to the cover 2 by one or more rivets 50, 150 through both the fastener and the cover 2 to prevent its easy removal from the cover 2. This embodiment, as illustrated in FIGS. 18-22 and 25-27, does not make use of a ring. In another embodiment of a fastener 220, as shown in FIG. 28, the fastener 220 may likewise incorporate rivets (not shown) to fix the fastener 220 to a cover. Obviously, other appropriate forms of fasteners may also be used as well in conjunction with this invention.

The handle portion 22, 122, 222 promotes easy manipulation of the fastener 4B, 20, 120, 220. It is configured so that it can be comfortably gripped between two fingers while applying or removing the fastener 4B, 20, 120, 220 from the frame. Thus, it angles away from the hooked portion 24, 124, 224 the tightening member 28, 128, 228 and the booth structure when installed. In this regard, the handle portion 22, 122, 222 may be curved as shown in the embodiment of FIG. 7 or as shown in the embodiments of FIGS. 13-14, 19-22, and 25-28, or it may be cylindrical with a finger score 22C as shown in FIG. 16. Additional details pertaining to alternative embodiments of the fastener 120 depicted in FIGS. 25-27, and the fastener depicted in FIG. 28 are provided below.

In the embodiments of the fastener 4B, 20, and as depicted most clearly in FIGS. 5, 7 and 16, the hooked portion 24 includes a curvature 24C for attachment to a ring 11 and a hook end 24E to grasp the edge of the Frame F. The curvature and length of the structure is particularly designed for connection with frame F depicted in FIG. 7 typical of the support structures used to construct trade show exhibit booths. As shown in FIG. 7 (and FIG. 26), the support structure has a central opening 32 and a group of arc-shaped openings 34 around the periphery of the core and extensions 30 that define a perimeter around the periphery of the core. These poles serve a dual purpose of connecting walls or partitions around non-presentation sides of a booth. As designed, the fastener 4B by the hook end 24E grips onto an open channel of the pole core while the tightening member 28 projects into a second channel to attach the fastener 4B to the frame pole.

Figure 13:
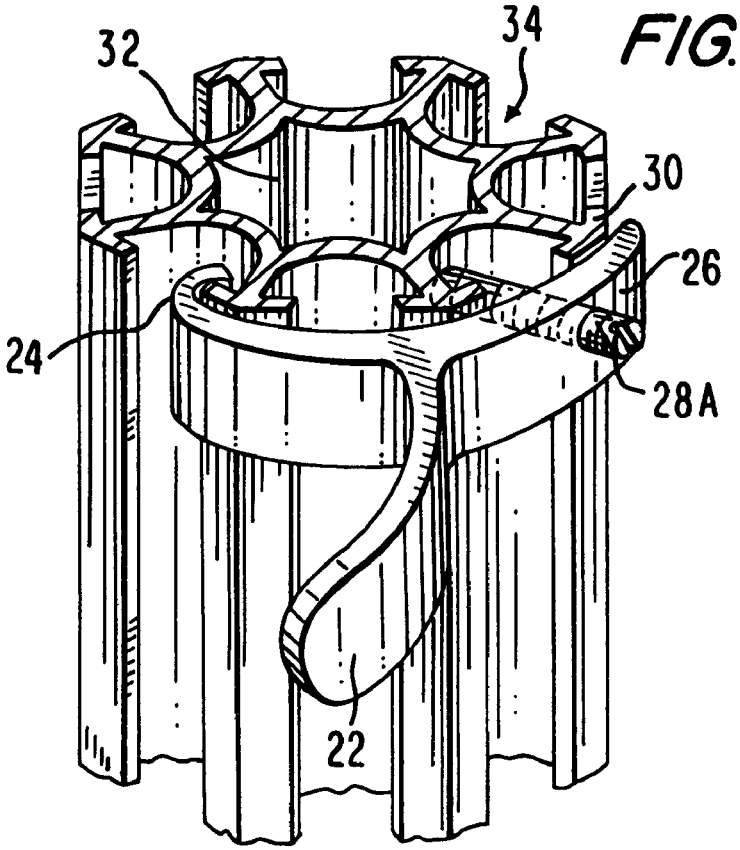
FIG. 13 is a cross sectional view of the fastener of FIG. 12.
Figure 14:
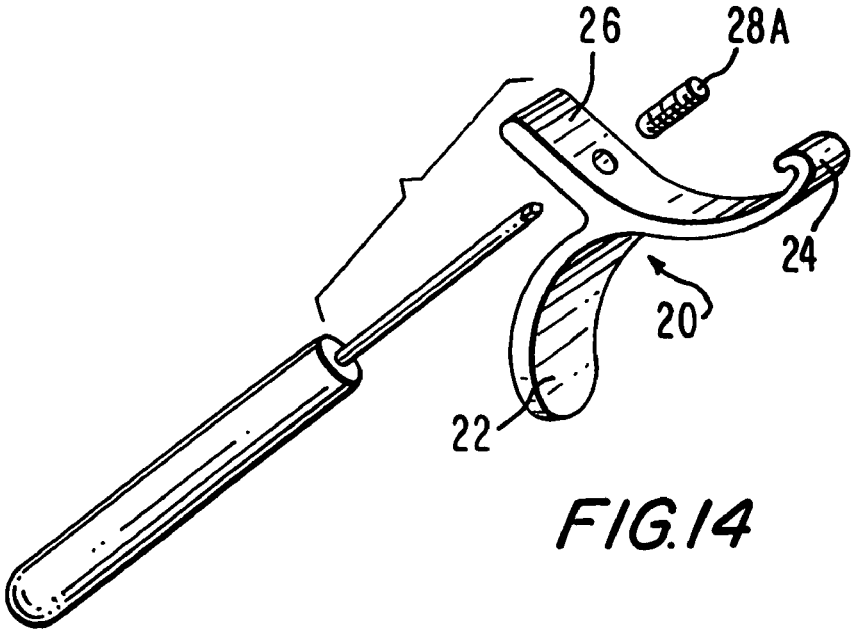
FIG. 14 is an elevational view of the fastener of FIG. 12.
Figure 15:
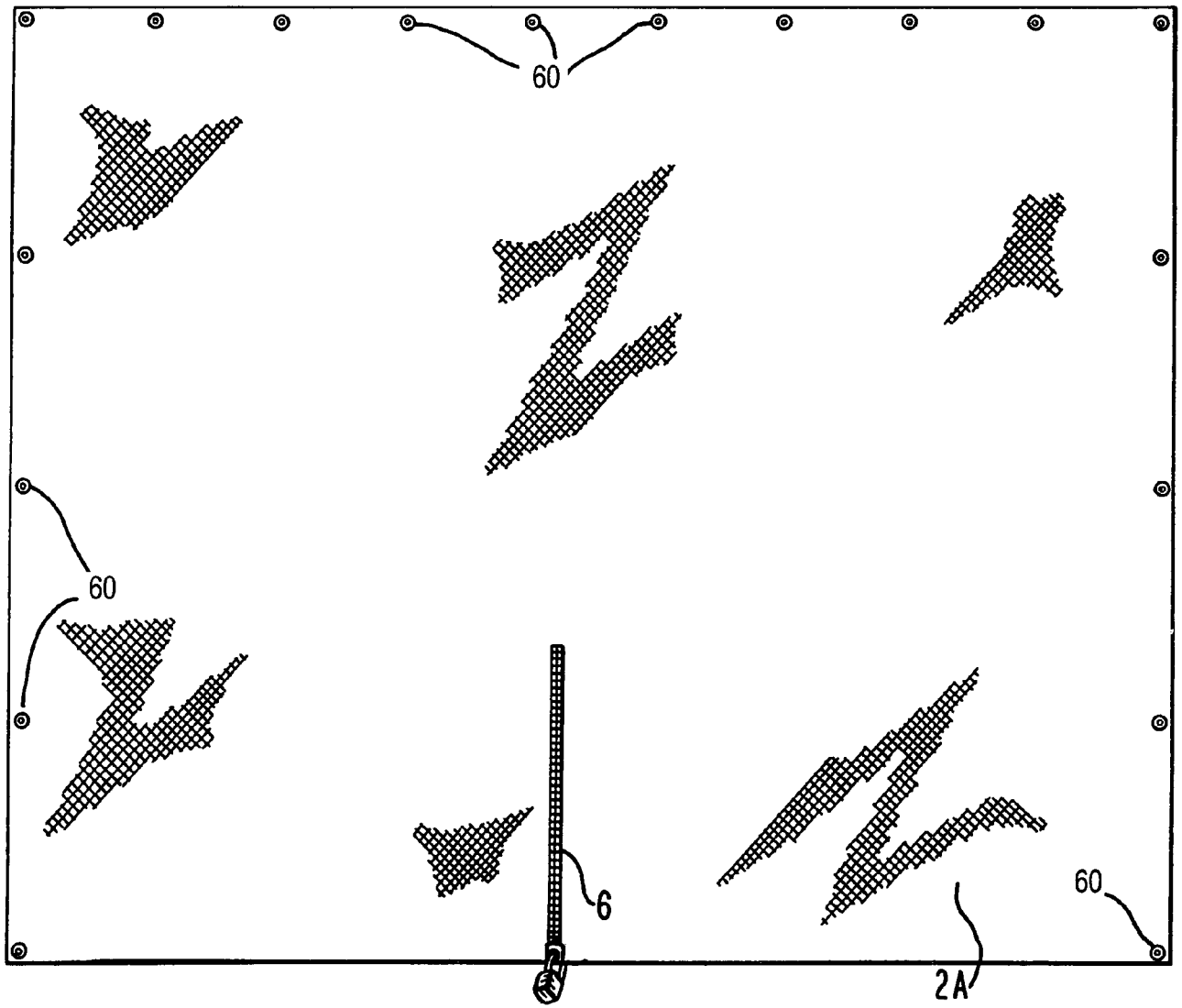
FIG. 15 is a front view of the cover apparatus of FIG. 11.
Figure 19:
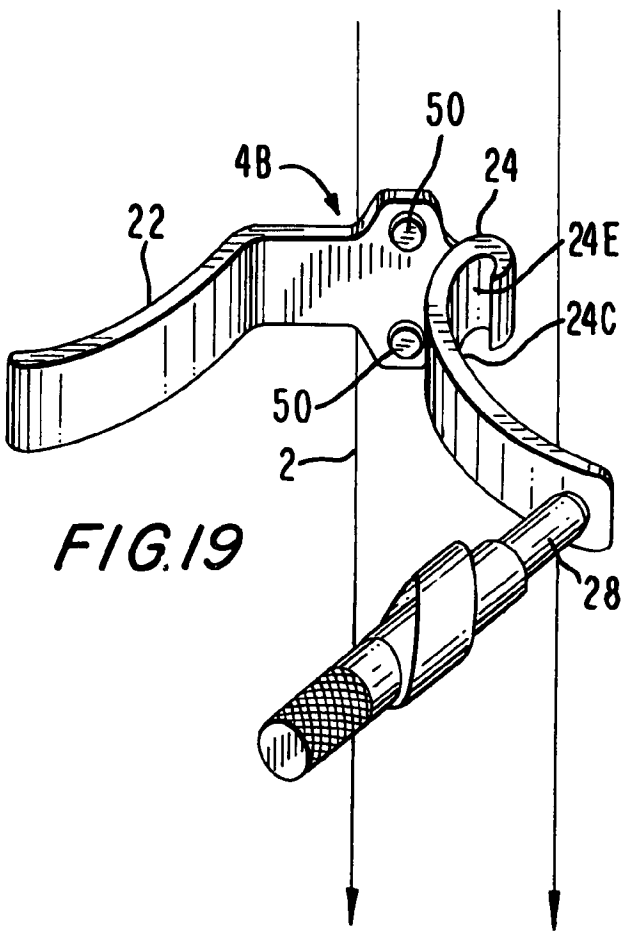
FIGS. 19-22 depict additional embodiments of a fastener of the invention.
Figure 18:
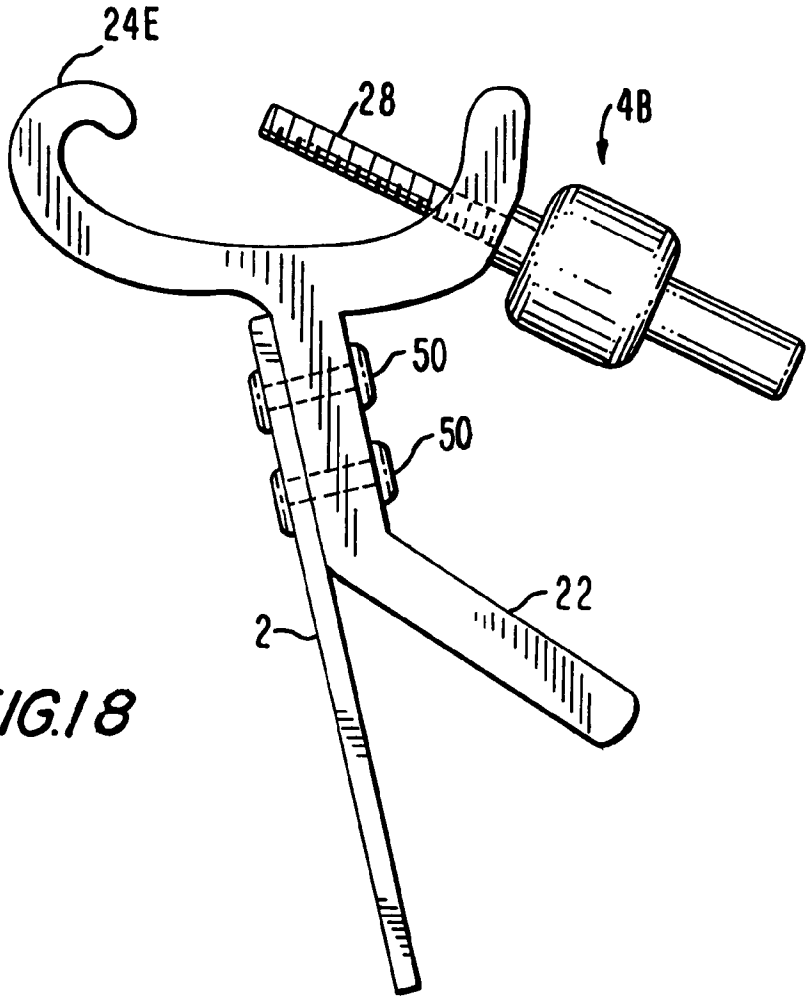
FIG. 18 depicts a side plan view of another embodiment of a fastener of the invention fixed to the cover, a portion of which is shown by cross-section.
Figure 20:
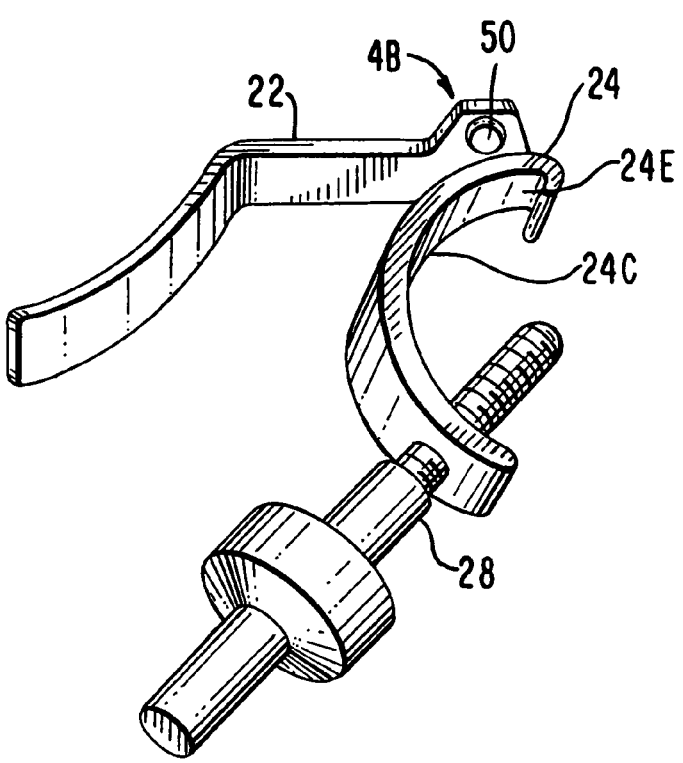
Figure 21:
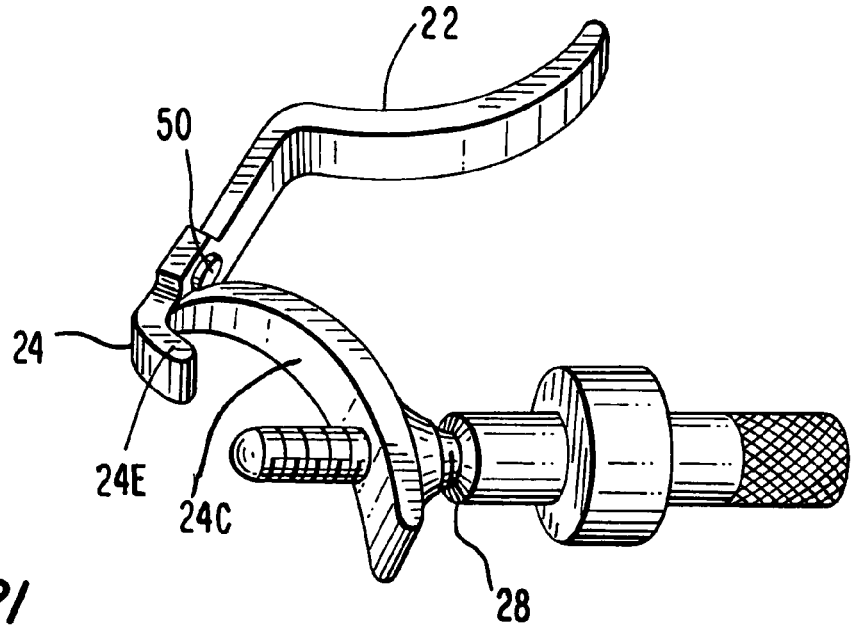
Figure 22:
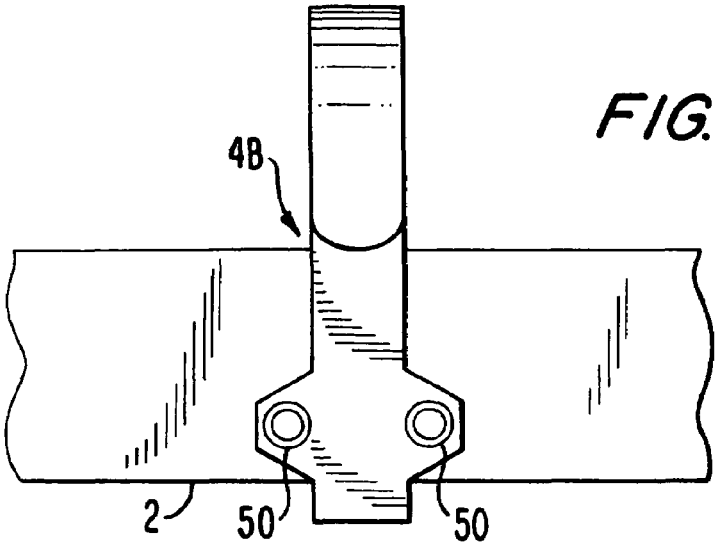

The tightening member 28 serves a securing purpose when tightened by protruding into the frame F reducing the distance between to the hook end 24E and the tightening member 28. The tightening member 28 has threads to match the threads in an aperture of the hooked portion 24. The tightening member 28 is preferably supplied with finger holds of various shapes and configurations for manual application to increase the torque of the user in tightening the threads and/or textured grooves or similar construction to improve grip. Optionally, as shown in FIGS. 13 and 14, the tightening member 28A may be supplied with a tool end such as a hex head, Phillips head or other bolt head for use with an automated device such as a drill with an appropriate tool insert. Like that of the handle, the tightening member is angled away from the handle portion 22 and the booth structure when installed to promote easy manipulation for installation or removal.

Figure 25:
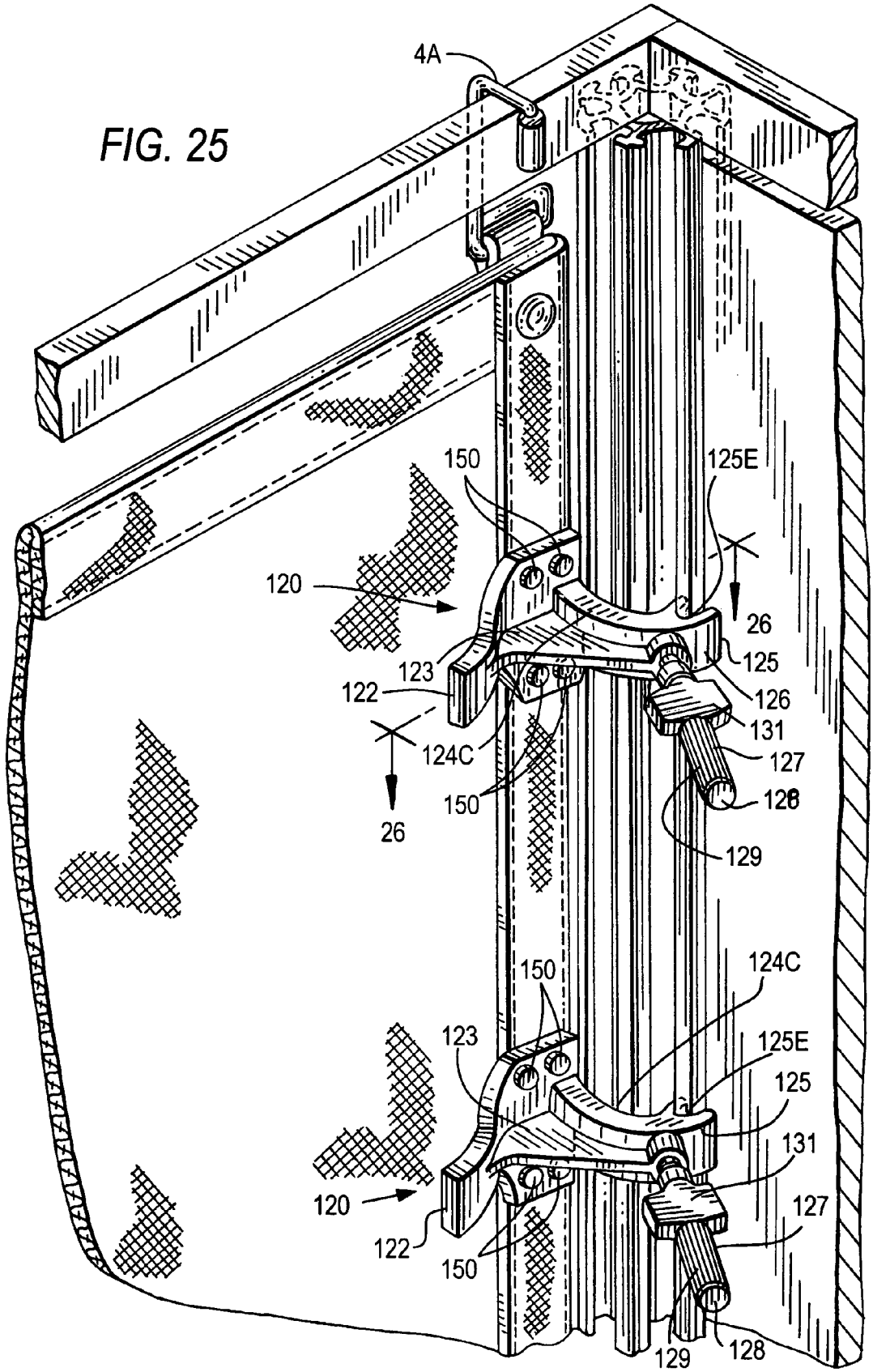
FIG. 25 depicts an interior view of a portion of a cover of the invention attached to booth support structure as shown in FIG. 5, with an alternative embodiment of a fastener.
Figure 26:
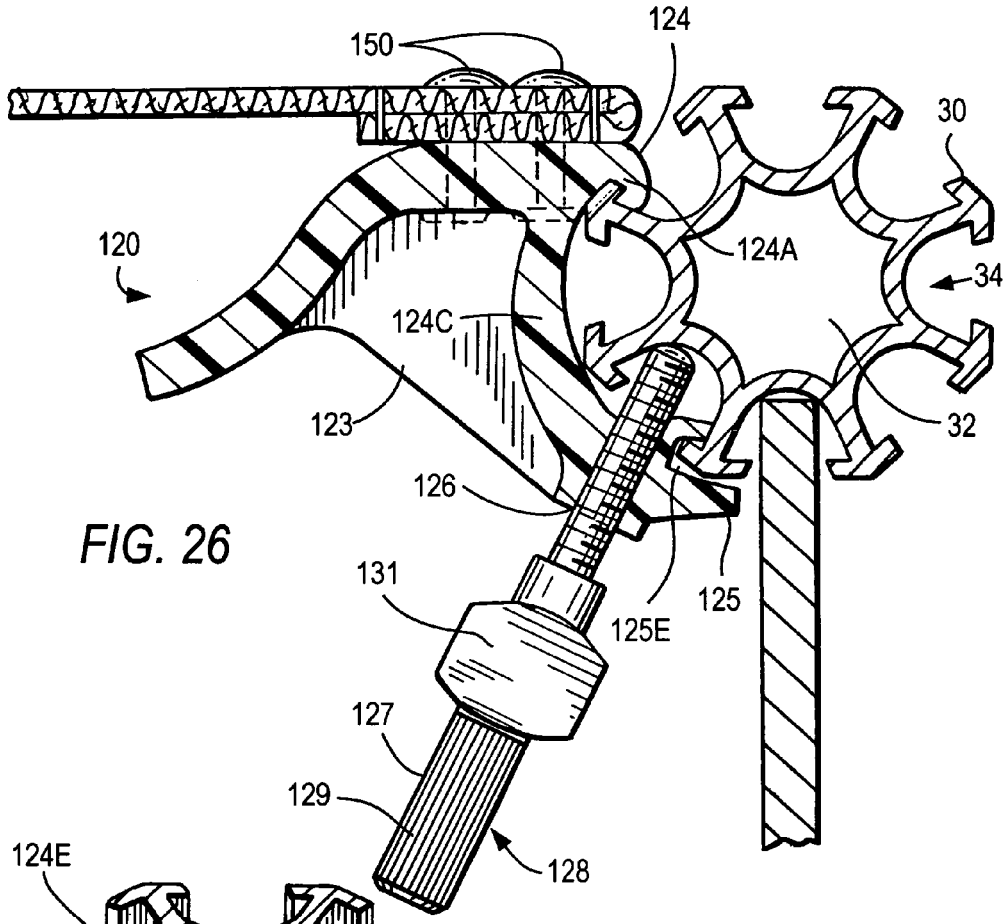
FIG. 26 is a plan view cross-section of the fastener shown in FIG. 25 engaging a vertical booth support structure, taken along lines 26-26 of FIG. 25.
Figure 27:
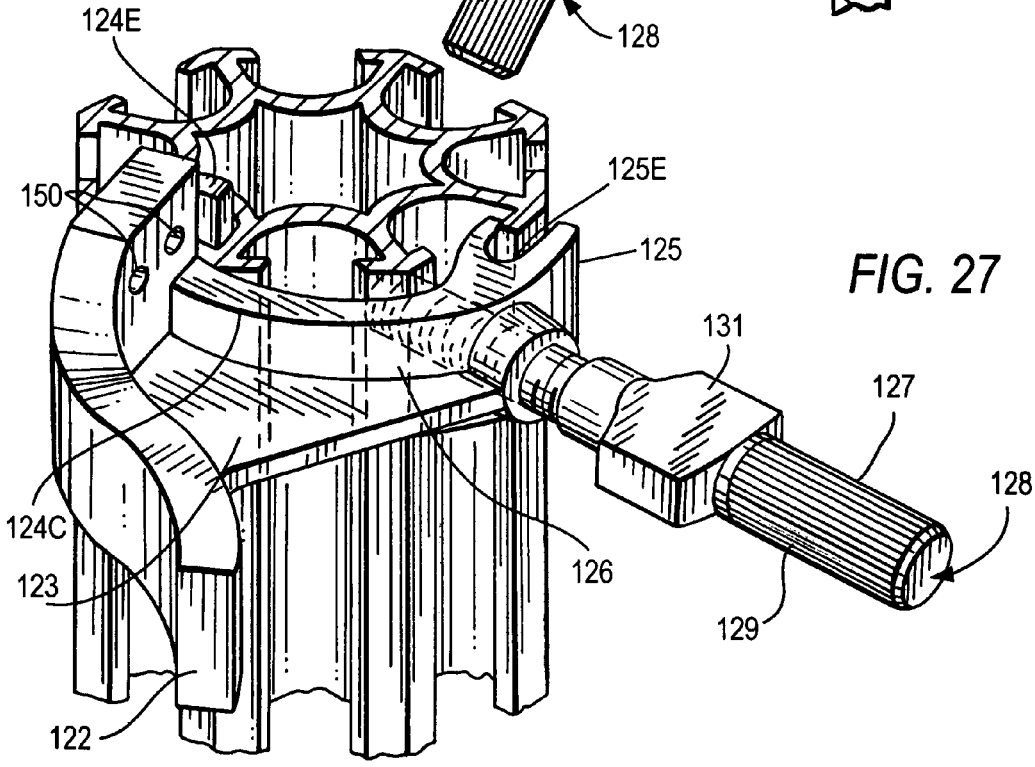
FIG. 27 is a perspective view of the fastener shown in FIG. 25 engaging a vertical booth support structure.
Figure 28:
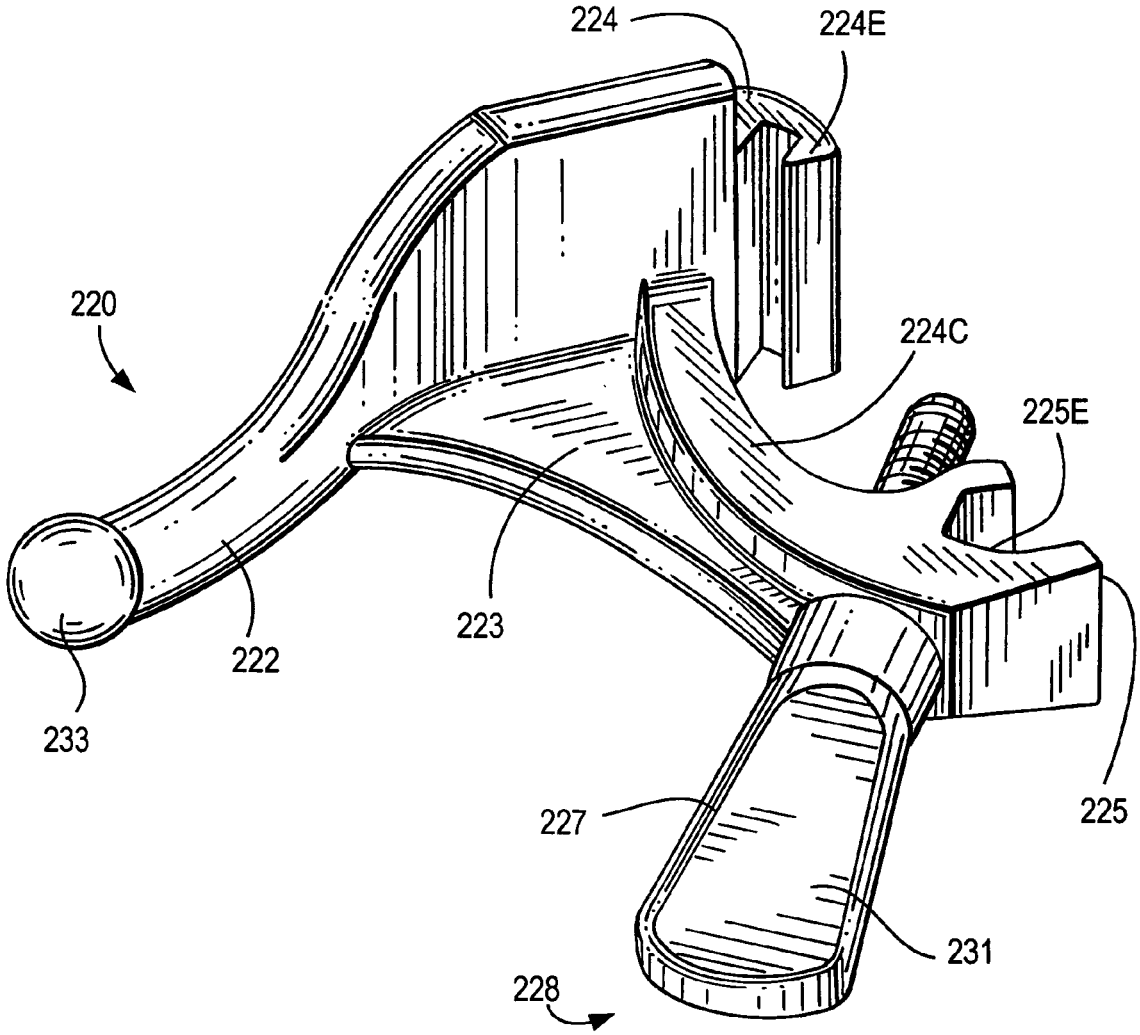
FIG. 28 depicts an alternative embodiment of the fastener shown in FIGS. 25-27.

FIGS. 25-27 depict another embodiment of a fastener 120 engaged to a support structure. This fastener 120 has a number of basic features and functions in common with the previously presented embodiments of the fasteners 4B, 20. Accordingly, it should be understood that one or more of the elements of the fasteners 4B, 20, (i.e., the tightening member 28, 28A, handle 22 etc.) may be replaced with those of the fastener 120, and vice versa.

As in some of the embodiments discussed above, the fastener 120 is preferably fixedly connected to the cover section by rivets 150. To provide for extra reinforcement, each fastener 120 is held in place by four rivets 150 rather than just two. Contrasted with the aforementioned embodiments, however, and as shown most clearly in FIG. 26, this fastener 120, in addition to a hooked portion 124 and hooked end 124E, also has an engagement portion 125 having an arc-shaped engagement end or lip 125E at an opposing extremity 126 of the fastener 120 which provides for a direct and "faced " engagement by the fastening member 120 of at least one of the extensions 30 of the support structure. In this embodiment of the fastener 120, there are preferably three or more contact points at which the fastener 120 and support structure are in contact with one another when the fastener 120 is attached. In particular, there are preferably contact points where (1) the hooked end 124E meets an extension 30 of the support structure, (2) the engagement end 125E meets an extension 30 of the support structure, and (3) the end of the tightening member 128 meets the support structure when inserted into an open channel 34 thereof. That the fastener 120 has a faced engagement achieved by the engagement end 125E, in addition to the hooked connection at the hooked end 124E, provides for a firmer, more stable and steady connection relative to the fasteners 4B, 20 which themselves lack the faced engagement end 125E. It should further be understood that the engagement portion 125 and end 125E, which provide for faced engagement, may replace the hooked portions 24, 124 and ends 24E, 124E found in the embodiments above.

The fastener 120 depicted in FIGS. 25-27 likewise comprises a curved handle portion 122 and a tightening member 128. The tightening member 128 works in conjunction with the engagement portion 125, end 125E, hooked portion 124 and end 124E. The tightening member 128 has threads to match the threads in an aperture of the hooked portion 124. The rearward end of the tightening member 128 has a cylindrical finger hold 127 with a textured grip 129 to increase the torque in the manual application and tightening of the tightening member 128. The tightening member 128 also has a flattened surface grip section 131 at an intermediary area of the tightening member 128 which likewise provides for improved grip and performance in securing the fastener 120 to the support structure. Although the surface grip 131 shown in FIGS. 25-27 is generally flat and even, it may optionally comprise a textured, rough and/or concave surface to provide for an easier grip and handling in securing the fastener 120 to the support structure.

Adjacent to the handle portion 122 is a support brace 123 abutting or otherwise between the hooked portion 124 and engagement portion 125 which helps prevent the fastener 120 from deforming as a result of repetitive use. The support brace 123 is integrally molded to the fastener 120. As in the embodiments discussed above, the fastener 20 shown in FIGS. 25-27 is made from a rigid and durable material such as a metal or alloy. Alternatively, all embodiments of the fasteners 4B, 20 may be constructed of plastic which can be molded in a variety of forms.

FIG. 28 depicts a further embodiment of a fastener 220. This fastener 220 has a number of basic features and functions in common with the previously presented embodiments of the fasteners 4B, 20, 120. Accordingly, it should be understood that one or more of the elements of the fasteners 4B, 20, 120 may be replaced with those of the fastener 220, and vice versa.

Although shown apart from a cover, the fastener 220 is preferably fixedly connected to a cover section by rivets as with some of the previously discussed embodiments. When connected, four rivets are preferably used to connect the fastener 220 to a cover or section of material. Similar to the embodiment of the fastener 120 shown in FIGS. 25-27, the fastener 220 has an engagement portion 225, in addition to a hooked portion 224. The engagement portion 225 has a combination arc-shaped and faceted engagement end or lip 225E at an opposing extremity 226 of the fastener 220 which provides for a direct and "faced" engagement by the fastening member 220 of at least one of the extensions of the support structure. It should be understood that the end 225E of the fastener 220, as well as the end 125E of the fastener 120, may be entirely curved or faceted, or comprise a combination of one or more curves and one or more facets.

Like the embodiment shown in FIGS. 25-27, there are preferably three or more contact points at which the fastener 220 and support structure are in contact with one another when the fastener 220 is attached. The contact points that are present when the fastener 220 is utilized are in the same general locations as those that are present when the fastener 120 is employed. As with the fastener 120, the fastener 220 also has a faced engagement achieved by the engagement end 225E which provides for a firmer more stable and steady connection relative to the fasteners 4B, 20 which themselves lack the faced engagement end 125E, 225E. It should further be understood that the engagement portion 225 and end 225E, which provide for faced engagement, may replace the hooked portions 24, 124, 224 and ends 24E, 124E, 224E.

The fastener 220 depicted in FIG. 28 comprises a tightening member 228 and a curved handle portion 222 with a blunt, partially-spherical end 233 which aids in securely holding the handle portion 222. The tightening member 228 works in conjunction with the engagement portion 225, end 225E, hooked portion 224 and end 224E. The tightening member 228 has threads to match the threads in an aperture of the hooked portion 224. The rearward end of the tightening member 228 has a generally flattened finger hold 227 with a smooth surface grip 231 to increase the torque in the manual application and tightening of the tightening member 228. Although the surface grip 231 is generally flat and even, it may optionally comprise a textured, rough and/or concave surface to provide for an easier grip and handling in securing the fastener 220 to the support structure.

This embodiment of the fastener 220 also preferably comprises a support brace 223 adjacent to the handle portion 222, which is abutting or between the hooked portion 224 and engagement portion 225. As in the embodiments discussed above, the fasteners 120, 220 shown in FIGS. 25-27 and FIG. 28 are made from a rigid and durable material such as a metal or alloy. Alternatively, all embodiments of the fasteners 4B, 20, 120, 220 may be constructed of rigid plastic which can be molded in a variety of forms.

It is noted that in the designs described herein and as illustrated in the drawings, use of the fastener 4B, 20, 120, 220 is not itself lockable, but when combined with the cover 2, the fasteners are secure, since the design of the fastener is such that it is removable from only one side of the cover as illustrated in FIGS. 5,7, 25 and 26. When the handle portion 22, 122, 222 and tightening member 28, 128, 228 are internal to the booth structure and the hook end 24E, 124E, 224E is external to the booth structure relative to the cover 2, the cover 2 prevents the fastener 4B, 20, 120, 220 from being removed. By then locking an access opening 6 previously discussed, the cover 2 will provide a level of protection from access to the booth. Although fasteners may themselves be supplied in a lockable form to secure the cover 2 by installation from an exterior side of the cover 2 of the booth, the apparatus comprising non-locking fasteners has particular advantages over other locking fastener structures because it is simpler to use.

Optionally, fasteners may be used to secure the bottom edge of the cover as well. However, if the cover is properly sized and taut across the frame F they are not necessary. To assist in this purpose, an optional adjustment belt 14 is supplied on the cover 2. An adjustment belt 14 is shown in FIGS. 1 and 2 and in greater detail in FIGS. 3 and 4 along the bottom edge of the cover 2. Two separate lengths of the adjustment belt 14 are each fixed on opposing portions of the cover 2. As loose ends of the adjustment belt 14 are drawn together it eliminates excess slack in the cover 2 that may be present because of minor differences between the dimensions of the cover 2 and the space between support structures. The loose ends of the adjustment belt 14 are supplied with grommets 16 for receiving a lock 8. The grommets 16 of the adjustment belt 14 may be positioned proximate to the access opening 6 when included in the invention for locking therewith. In this way a common lock can secure the adjustment belt 14 and the access opening 6.

In use, the embodiments of the invention discussed herein provide an apparatus that appropriately addresses the problem experienced by tradeshow exhibitors and booth operators. It can also provide some privacy when the exhibitor is setting up an exhibit before or between shows. In order to install, the flexible cover 2 is unfolded. With the hangers 4C, 4D, 4E or hooks 4A at the top horizontal edge of the cover 2 resting on a horizontal cross bar on the booth, the cover 2 is extended across a presentation side of the booth. When fasteners 4B, 20, 120, 220 are not applied to the cover 2 with rivets 50, 150 the fasteners 4B, 20, 120, 220 are then inserted through rings 12 at the curvature 24C, 124C, 224C or ring portion of the loops 10 at the side vertical edges of the cover 2. From the inside of the booth, while gripping the handle portion 22, 122, 222 of the fasteners 4B, 20, 120, 220 the hook end 24E, 124E, 224E is extended to grasp an edge of a channel of a frame F post. The tightening member 28, 28A, 128, 228 is then applied to another channel of the post until tight. When all of the fasteners 4B, 20, 120, 220 are so applied to the booth's support posts, the booth is exited through the access opening 6. The access opening 6 is then closed and the adjustment belt 14 is drawn together. Both are then secured by a lock 8. Of course, full presentation access to the booth may be accomplished by removing the lock 8, entering the access opening 6 and removing the fasteners 4B, 20, 120, 220. The cover 2 may then be removed from the top horizontal cross bar by lifting the hangers 4C, 4D, 4E or hooks 4A from the cross bar and compactly folding the cover. Alternatively, the cover 2 can be compactly tied back at one side of the booth by sliding the cover 2 on the hangers 4C, 4D, 4E or hooks 4A while leaving them on the cross bar.

Although the invention is described in terms of particular embodiments, it is to be understood that the embodiments are merely illustrative of an application of the principles of the invention. Numerous modifications may be made and other arrangements may be devised without departing from the spirit and scope of the invention.

I claim:

1. A security system for guarding an interior area enclosed by three or more sides comprising;

a section of material;

a plurality of pairing members;

a plurality of fastening members for fastening said material to a support structure by said pairing members said fastening members comprising (a) a tightening member adapted to be manually untightened away from and tightened against said support structure and (b) a hooking portion and a hooking end, said hooking end adapted to engage said support structure in conjunction with said tightening member; and means for entrance and exit;

wherein said pairing members are connected to said material; and wherein each of said plurality of fastening members are constructed for attachment to said structure in a manner to permit fastening and unfastening from only one side of said material when fastening members are attached to said structure with the section of material.

2. The security system of claim 1, said fastening members further comprising an engagement portion and an engagement end opposite said hooking end adapted to engage said support structure in conjunction with said hooking end and said tightening member.

3. The security system of claim 2, said engagement end adapted to facedly engage said support structure.

4. The security system of claim 3, said engagement end being arc shaped.

5. A security system for guarding an interior area enclosed by three or more sides comprising;

a section of material;

a plurality of pairing members;

a plurality of fastening members for fastening said material to a support structure by said pairing members said fastening members comprising (a) a tightening member adapted to be manually untightened away from and tightened against said support structure and (b) an engagement portion and an engagement end, said engagement end adapted to facedly engage said support structure; and means for entrance and exit;

wherein said pairing members are connected to said material; and wherein each of said plurality of fastening members are constructed for attachment to said structure in a manner to permit fastening and unfastening from only one side of said material when fastening members are attached to said structure with the section of material.

6. The security system claim 5, said engagement end being arc shaped.

7. A security system for protecting and safeguarding contents of a booth having an interior comprising:

a section of material having a bottom edge, a top edge, two side edges, an interior surface facing said interior of said booth and an exterior surface;

a plurality of fastening members attached to said section of material at said side edges, said fastening members comprising a hooking end, an engagement end opposite said hooking end and a tightening member between said hooking end and said engagement end for fastening said material to a support structure; and means for entrance and exit disposed in said section of material.

8. The security system of claim 7, said plurality of fastening members being constructed for attachment to said structure to permit fastening and unfastening from only one side of said material when fastening members are attached to said structure with said section of material.

9. The security system of claim 7, said means for entrance and exit being securable by a lock.

10. The security system of claim 9, said means for entrance and exit being further securable by a belt.

11. The security system of claim 10, said belt being disposed at said bottom edge.

12. The security system of claim 7, said fastening members being attached to said material by rivets.

13. The security system of claim 7, further comprising a plurality of fastening members attached to said section of material at said top edge.

14. The security system of claim 13, said plurality of fastening members attached to said section of material at said top edge comprising a projection, said projection adapted for removable connection to a lifting device.

15. The security system of claim 7, said fastening members attached to said section of material at said side edges and at said interior surface.

16. The security system of claim 7, said fastening members further comprising a handle portion.

17. A security system for guarding an interior area comprising: a section of material; a plurality of fastening members attached to said section of material for fastening said material to a support structure, at least one of said fastening members comprising a hooked end, an arc shaped engagement end and a tightening member, said hooked end and tightening member working together to attach said fastening members to said structure, and said arc shaped engagement end adapted to connect to one of said extensions of said support structure; a handle portion attached to said fastening members for holding said fastening members while attaching said fastening members to said structure; and means for entrance exit; wherein said support structure comprises extensions that define a perimeter, said hooded end adapted to connect to one of said extensions of said support structure.

18. The security system of claim 17, said fastening member further comprising a brace between said handle portion and said engagement end.

19. The security system of claim 17, said fastening members comprise an end for direct faced engagement to one of said extensions of said support structure.

20. The security system of claim 17, said handle portion comprising a textured gripping surface.

21. A security system for guarding an interior area enclosed by three or more sides comprising:

a section of material;

a plurality of fastening members attached to said section of material for fastening said material to a support structure, at least one of said fastening members comprising an arc shaped engagement end and a tightening member, said engagement end and tightening member working together to attach said fastening members to said structure;

a handle portion attached to said fastening members for holding said fastening members while attaching said fastening members to said structure; and means for entrance and exit.

22. The security system of claim 21, said arc shaped engagement end being adapted for faced engagement to an extension of said structure.

* * * * *